US006276973B1

(12) United States Patent
Lin et al.

(10) Patent No.: US 6,276,973 B1
(45) Date of Patent: Aug. 21, 2001

(54) CONTACT OF ELECTRICAL CONNECTOR

(75) Inventors: Yu Hsu Lin, Fremont, CA (US); Wen-Tsung Wang; Yu Hung Huang, both of Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/516,474

(22) Filed: Mar. 1, 2000

(51) Int. Cl.[7] ..... H01R 4/48

(52) U.S. Cl. ..... 439/862

(58) Field of Search ..... 439/862, 342, 439/515

(56) References Cited

U.S. PATENT DOCUMENTS 6,086,401 * 7/2000 Hsiung et al. ..... 439/862

* cited by examiner

*Primary Examiner*—Gary F. Paumen
(74) *Attorney, Agent, or Firm*—Wei Te Chung

(57) ABSTRACT

A contact of an electrical connector includes an upper section for engaging a pin of a central processing unit module, a lower section retained in a bore defined in a housing of the connector with a tail section extending therefrom for being electrically connected to a circuit board and a plurality of spaced connecting sections, serving as signal transmission channels, arranged between the upper and lower sections and electrically connected thereto to serve as electrical current channels. By increasing the number of the connecting sections, the total cross-sectional area of the electrical channels is increased which effectively reduces the inductance thereof.

1 Claim, 4 Drawing Sheets

CONTACT OF ELECTRICAL CONNECTOR

BACKGROUND OF THE INVENTION

1. Field of the Invention

The present invention generally relates to a contact of an electrical connector, and in particular to a contact of a socket connector for retaining a semiconductor device, such as a central processing unit (CPU) module on a circuit board.

2. The Prior Art

Socket connectors for retaining and electrically connecting a CPU module to a circuit board are known in the art. A socket connector comprises an insulative housing defining an array of bore therein for receiving and retaining conductive contacts. Each contact has a body portion from which a tail and a mating section extend in opposite directions. The body forms an electrical channel between the mating section and the tail. The tail extends beyond a lower face of the housing for being received in a corresponding pin opening defined in the circuit board. The mating section engages with a corresponding conductive terminal extending from the CPU module to establish electrical connection between the CPU module and the circuit.

With the increase of the operational frequency of CPUs, the contacts of the socket connector are subject to severe requirement in electrical properties, among which impedance, especially inductance, of the contact is one of the major problems to be addressed. The body of he contacts of the conventional socket connectors, such as those disclosed in the above mentioned prior art, forms a single signal transmission channel having a limited cross-sectional area thereby leading to difficulty in reducing inductance.

It is thus desired to provide a contact structure which overcomes the above problem encountered in high frequency operation of the CPUs.

SUMMARY OF THE INVENTION

Accordingly, an object of the present invention is to provide a contact for a socket connector having reduced impedance.

Another object of the present invention is to provide a contact for a socket connector having an increased cross-sectional area for reducing the inductance thereof.

A further object of the present invention is to provide a contact for a socket connector having a body forming at least two spaced signal transmission channels thereby effectively increasing the cross-sectional area thereof and reducing the inductance.

To achieve the above objects, a contact of a socket connector in accordance with the present invention comprises an upper section for engaging a pin of a central processing unit module, a lower section retained in a bore defined in a housing of the connector with a tail section extending therefrom for being electrically connected to a circuit board and a plurality of spaced connecting sections, serving as signal transmission channels, arranged between the upper and lower sections and electrically connected thereto to serve as electrical current channels. By increasing the number of the connecting sections, the total cross-sectional area of the electrical channels is increased which effectively reduces the inductance thereof.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENT

Figure 1:
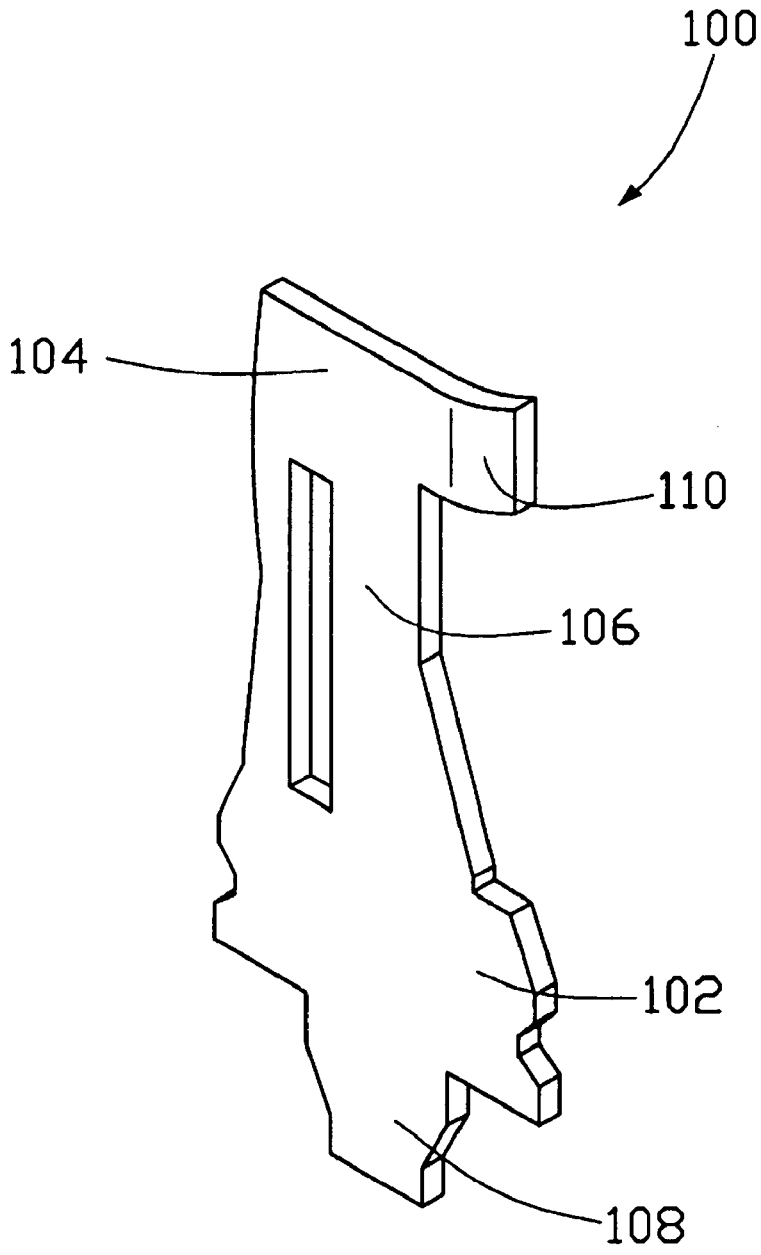
FIG. 1 is a perspective view of a contact in accordance with a first embodiment of the present invention.

Referring to the drawings and in particular to FIG. 1, a contact of an electrical connector constructed in accordance with a first embodiment of the present invention, generally designated with reference numeral 100, comprises a lower, retention section 102 and an upper, mating section 104 connected to the retention section 102 by at least two spaced connecting sections 106 arranged therebetween. A tail section 108 extends from the lower section 102 in a direction opposite the upper section 104.

The contact 100 is received in a corresponding bore defined in a connector housing (not shown) and the retention section 102 is retained in the bore with the tail section 104 extending beyond a bottom surface of the housing for being mounted to a circuit board (not shown). A through hole technique may be used to fix the tail section 108 of the contact 100 to the circuit board wherein a pin opening is defined in the circuit board into which the tail section 108 is inserted and then soldered. Alternatively, a surface mount technology may be applied to solder the tail section 108 to the circuit board.

The mating section 104 forms an inclined surface 110 for guiding the engagement of a corresponding pin of a central processing unit (CPU) module (not shown) received in the bore of the connector housing with the contact 100.

In accordance with the present invention, at least two connecting sections 106 are formed between and electrically connect the upper section 104 to the lower section 106 for establishing electrical connection between the CPU module and the circuit board. The two connecting sections 106 forms two electrical channels or signal transmission channels between the upper and lower sections 104, 102. The two channels, as compared with the conventional one channel structure, provides a large cross-sectional area through which electrical current flows between the upper and lower sections 104, 102. By the large cross-sectional area, the overall inductance of the electrical channels between the upper and lower sections 104, 102 is effectively reduced.

Figure 2:
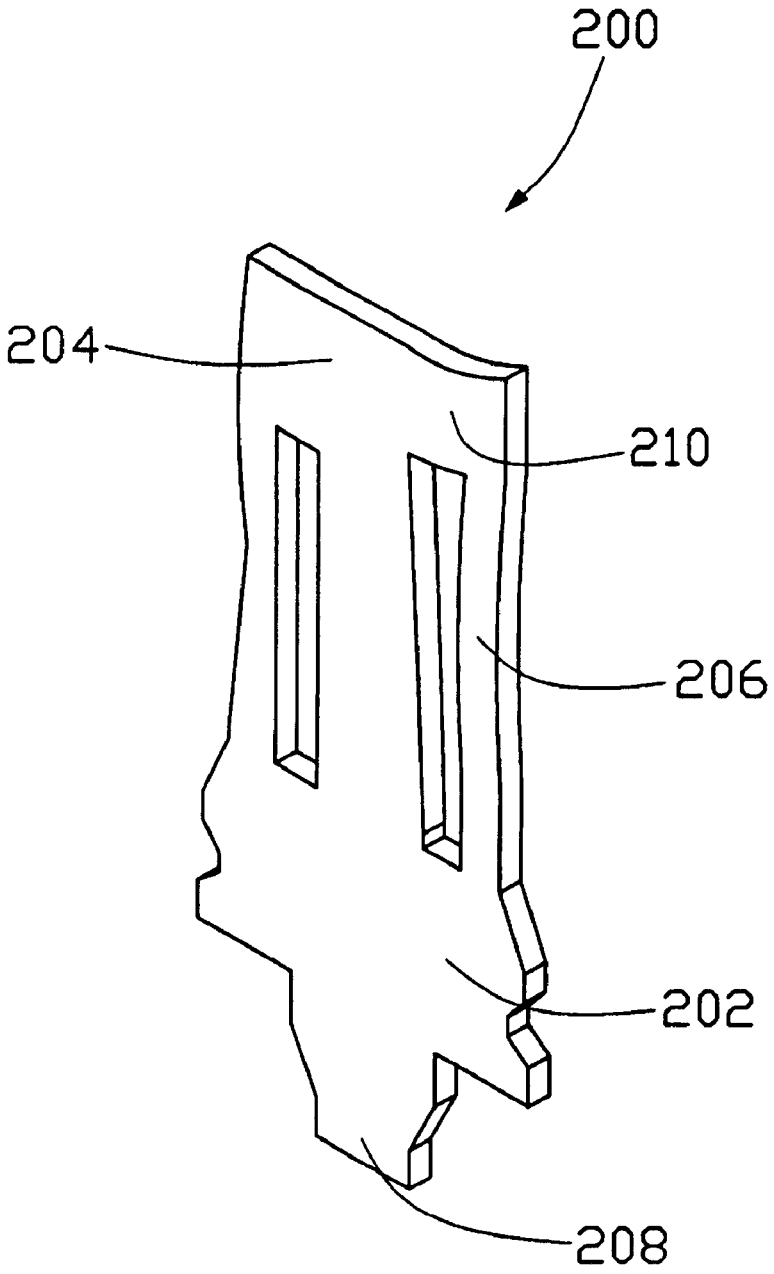
FIG. 2 is a perspective view of a contact in accordance with a second embodiment of the present invention.

FIG. 2 of the attached drawings shows a contact, designated by reference numeral 200, in accordance with a second embodiment of the present invention. The contact 200 comprises a lower, retention section 202 and an upper, mating section 204 connected to each other by three spaced connecting sections 206 arranged therebetween. A tail section 208 extends from the lower section 202 for being electrically connected to a circuit board (not shown). An inclination 210 is formed on the upper section 204 for facilitating engagement between the contact 200 and a corresponding pin of a CPU module (not shown).

As compared to the first embodiment discussed with reference to FIG. 1, the three connecting sections 206 of the contact 200 provide an even larger total cross-sectional area through which electrical current flows between the upper and lower sections 204, 202. Thus, the overall inductance between the upper and lower sections 204, 202 is effectively reduced.

Figure 3:
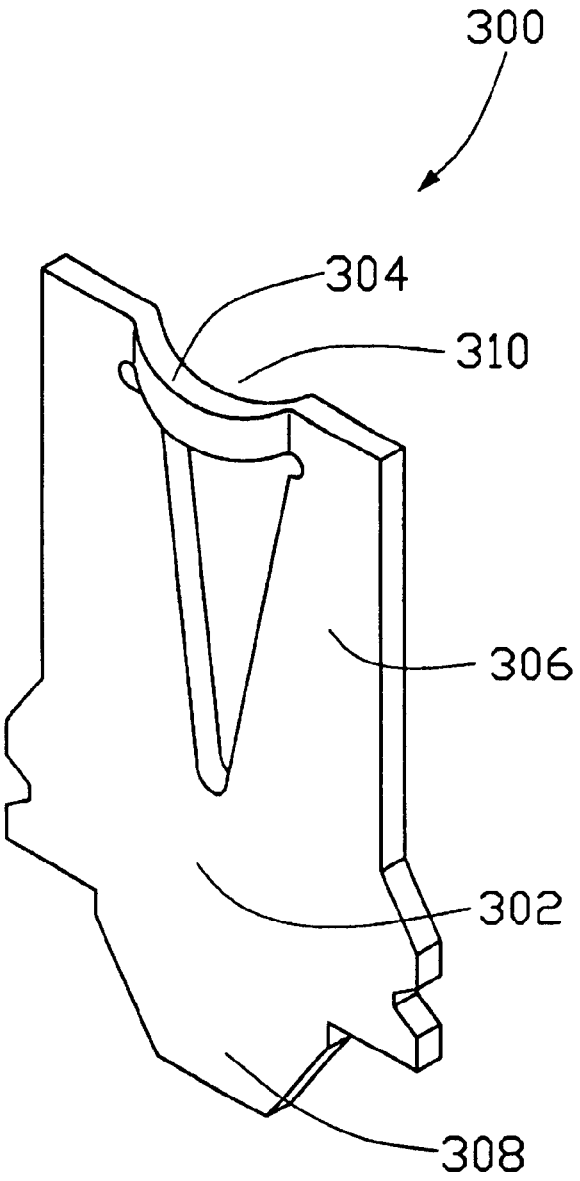
FIG. 3 is a perspective view of a contact in accordance with a third embodiment of the present invention.

FIG. 3 shows a contact, designated by reference numeral 300, in accordance with a third embodiment of the present invention. The contact 300 comprises a lower, retention section 302 and an upper, mating section 304 connected to each other by two spaced connecting sections 306 arranged therebetween. A tail section 308 extends from the lower section 302 for being electrically connected to a circuit board (not shown). An arcuate recess 310 is formed in the upper section 304 for receiving a corresponding pin of a CPU module (not shown) thereby forming electrical engagement therebetween. The connecting sections 306 are tapering from the lower section 302 toward the upper section 304 whereby a space between the connecting sections 306 is substantially triangular.

As discussed previously, the two connecting sections 306 of the contact 300 provide a large total cross-sectional area through which electrical current flows between the upper and lower sections 304, 302 whereby the overall inductance between the upper and lower sections 304, 302 is effectively reduced.

Figure 4:
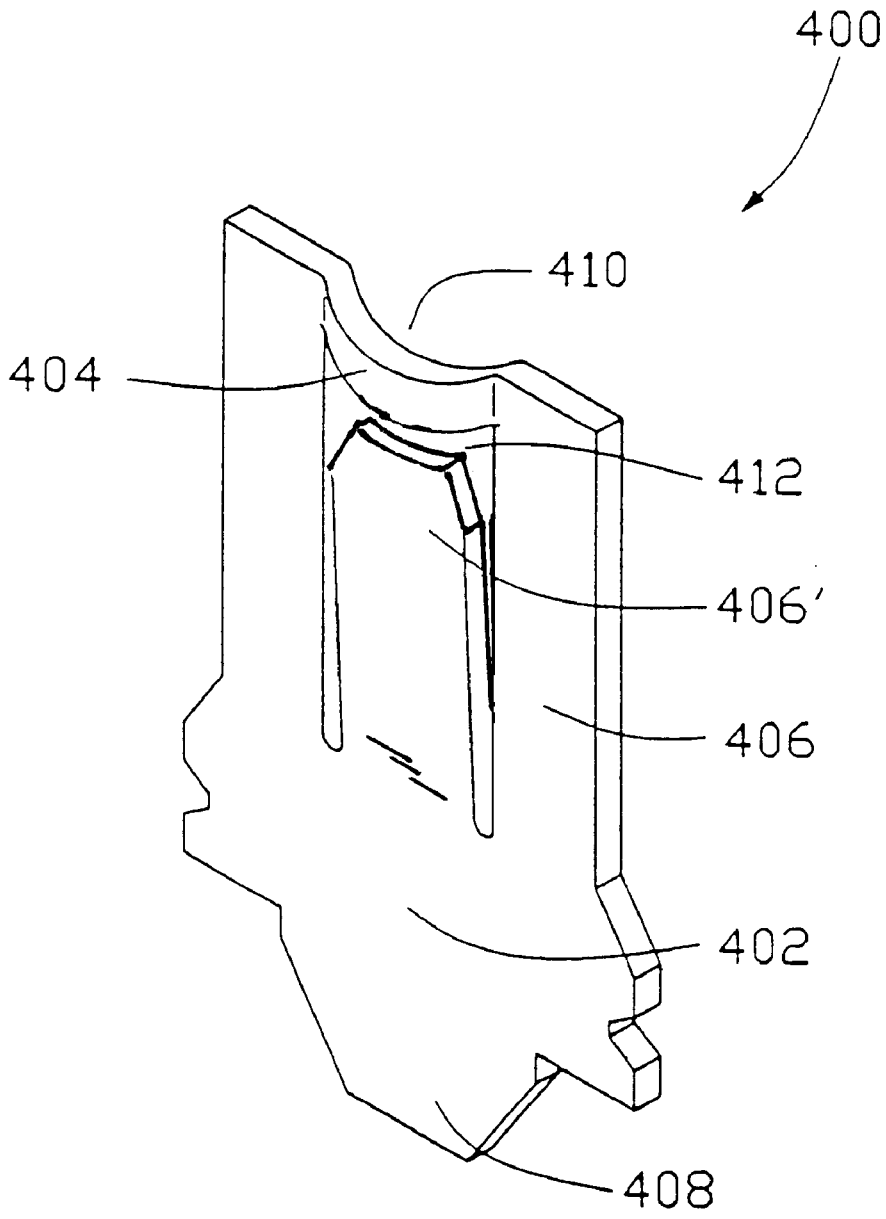
FIG. 4 is a perspective view of a contact in accordance with a fourth embodiment of the present invention.

FIG. 4 shows a contact, designated by reference numeral 400, in accordance with a fourth embodiment of the present invention. The contact 400 comprises a lower section 402 and an upper section 404 connected to each other by three spaced connecting sections, including a central connecting section 406' and two side connecting sections 406. A tail section 408 extends from the lower section 402 for being electrically connected to a circuit board (not shown). An arcuate recess 410 is formed in the upper section 404 for receiving a corresponding pin of a CPU module (not shown) thereby forming electrical engagement therebetween. The two side connecting sections 406 are fixedly connected to the upper and lower sections 404, 402, while the central connecting section 406' has a lower end fixedly connected to the lower section 402 and an upper end separated from the upper section 404 with a gap 412 therebetween. The gap 412 is such that when the pin of the CPU module is received in the recess 410, the upper section 404 is moved due to resilient deformation of the side connecting sections 406 thereby contacting the upper end of the central connecting section 406'. Thus, three electrical channels or signal transmission channels are formed between the upper and lower sections 404, 402 when the contact 400 engages the pin of the CPU module.

As discussed previously, the three connecting sections 406, 406' of the contact 400 provide a large total cross-sectional area through which electrical current flows between the upper and lower sections 404, 402 whereby the overall inductance between the upper and lower sections 404, 402 is effectively reduced.

It can be noted that by using plural parallel connection sections with a space(slot) between every adjacent two connection sections thereof, the invention may not only achieve the greater cross-section area for lowering the contact resistance of the individual contact, but also soften the contact for compliance with the normal force requirement of the contact with regard to the CPU pin, relative to the similar cross-section area without any space(slot) thereof. Moreover, the spaces(slots) result in greater amount of surface area of the contact due to the formed surface area surrounding each space(slot), which may affect the impedance in compliance with the electrical requirement. FIG. 4 further shows the two-step engagement arrangement between the contact and the CPU pin wherein the upper section 404 of the contact 400 projects laterally beyond the tip of the obliquely upwardly extending central connection section 406'. Thus, as mentioned before, the horizontally moved CPU pin will first engage the upper section 404 and then contact the tip of the central connection section 406', thus efficiently lowering the initial abutment force between the contact 400 and the CPU pin for the mechanical benefit while stilling keeping the optimal cross-section area and the greater surface area of the contact for the electrical benefit.

Although the present invention has been described with reference to the preferred embodiments, it is apparent to those skilled in the art that a variety of modifications and changes may be made without departing from the scope of the present invention which is intended to be defined by the appended claims.

What is claimed is:

1. A contact of an electrical connector comprising:

an upper section adapted to engage a conductive member of an electronic device;

a lower section adapted to be retained in a bore defined in a housing of the connector;

a tail section extending from the lower section beyond a bottom surface of the housing for being electrically connected to a circuit board; and a plurality of spaced connecting sections arranged between the upper and lower sections and electrically connected thereto for serving as signal transmission channels therebetween;

wherein three spaced connecting sections are electrically connected between the upper and lower sections;

wherein an arcuate recess section is formed in the upper section for receiving the conductive member of the electronic device;

wherein a central connecting section and two side connecting sections are connected between the upper and lower sections, the side connecting sections being fixedly connected to the upper and lower sections, the central connecting section having a lower end fixedly connected to the lower section and an upper end separated from the upper section with a gap formed therebetween, the gap being such that when the conductive member of the electronic device engages the upper section, the side connecting channels are deformed to have the upper section contacting the upper end of the central connecting channel.

* * * * *